US010393061B2

(12) United States Patent
Hayasaki

(10) Patent No.: US 10,393,061 B2
(45) Date of Patent: Aug. 27, 2019

(54) CYLINDER HEAD COOLING STRUCTURE

(71) Applicant: ISUZU MOTORS LIMITED, Shinagawa-ku, Tokyo (JP)

(72) Inventor: Tsunaki Hayasaki, Yokohama (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 15/750,467

(22) PCT Filed: Aug. 1, 2016

(86) PCT No.: PCT/JP2016/072533
§ 371 (c)(1),
(2) Date: Feb. 5, 2018

(87) PCT Pub. No.: WO2017/022720
PCT Pub. Date: Feb. 9, 2017

(65) Prior Publication Data

US 2018/0223767 A1 Aug. 9, 2018

(30) Foreign Application Priority Data

Aug. 5, 2015 (JP) ..... 2015-154783

(51) Int. Cl.
*F02F 1/36* (2006.01)
*F01P 3/02* (2006.01)
*F02F 1/40* (2006.01)

(52) U.S. Cl.
CPC ..... *F02F 1/36* (2013.01); *F01P 3/02* (2013.01); *F02F 1/40* (2013.01); *F01P 2003/024* (2013.01)

(58) Field of Classification Search
CPC ..... F02F 1/36; F02F 1/40; F01P 3/02; F01P 2003/024
See application file for complete search history.

(56) References Cited

U.S. PATENT DOCUMENTS 6,024,057 A 2/2000 Betchaku
2001/0006054 A1* 7/2001 Yoshizawa ..... F02B 1/12 123/295
2004/0187807 A1* 9/2004 Aketa ..... F01M 11/03 123/41.44

FOREIGN PATENT DOCUMENTS

JP H11-117803 A 4/1999
JP H11-229955 A 8/1999
(Continued)

OTHER PUBLICATIONS

International Search Report for related PCT application No. PCT/JP2016/072533 dated Aug. 30, 2016; English translation provided; 3 pages.

(Continued)

*Primary Examiner* — Jacob M Amick
*Assistant Examiner* — Charles Brauch
(74) *Attorney, Agent, or Firm* — Procopio, Cory, Hargreaves & Savitch LLP

(57) ABSTRACT

A cylinder head cooling structure includes: an intake-side cooling passage, inter-cylinder cooling passages, inter-port cooling passages, first cooling water supply passages that include an upstream end connected to a cooling water supply passage provided in a cylinder block of the engine and a downstream end which joins an upstream end of the inter-cylinder cooling passage; and blocking walls that are provided in the inter-cylinder cooling passages and extend obliquely in a direction from the exhaust ports of the cylinder on an upstream side to the intake ports of the cylinder on a downstream side to divide the inter-cylinder cooling passage.

5 Claims, 2 Drawing Sheets

(56) References Cited

FOREIGN PATENT DOCUMENTS

| | | | |
|---|---|---|---|
| JP | 2008-075506 | A | 4/2008 |
| JP | 2012-012959 | A | 1/2012 |

OTHER PUBLICATIONS

Written Opinion for related PCT application No. PCT/JP2016/072533 dated Aug. 30, 2016; 5 pages.

* cited by examiner

CYLINDER HEAD COOLING STRUCTURE

CROSS-REFERENCE TO RELATED APPLICATIONS

This application is a U.S. National Stage entry of PCT Application No: PCT/JP2016/072533 filed Aug. 1, 2016, which claims priority to Japanese Patent Application No. 2015-154783, filed Aug. 5, 2015, the contents of which are incorporated herein by reference.

TECHNICAL FIELD

The present invention relates to a cylinder head cooling structure.

BACKGROUND ART

As a cylinder head cooling structure, a type is known in which a longitudinal passage is provided on an intake side and an exhaust side of the cylinder head and extends in a longitudinal direction (hereinafter, also referred to as a vertical direction) of the engine. As such type of cooling structure, a structure is also known in which a plurality of horizontal passages are provided between cylinders of the cylinder head and extend in a transverse direction (hereinafter, also referred to as a horizontal direction) of the engine (for example, see Patent Literature 1).

CITATION LIST

Patent Literature

Patent Literature 1: JP-A-11-229955

SUMMARY OF THE INVENTION

Technical Problem

In the longitudinal passage, however, since a flow rate increases as cooling water goes to the downstream side, there is a problem that a flow rate balance is hardly realized between the cylinders or the intake ports and the pressure loss also increases. In addition, since the temperature of the cooling water rises toward the downstream side, there is also a problem that cooling efficiency of the cylinder on the downstream side lowers.

In the horizontal passage, meanwhile, since it is necessary to divide a water jacket for each cylinder or to form the water jacket in two upper and lower stages in order to improve cooling performance, there is a problem that manufacturing costs increase. In addition, since it is necessary to reduce the passage area in order to secure the flow rate, there is also a problem that castability deteriorates.

An object of a cooling structure of the present disclosure is to prevent an increase in pressure loss while effectively maintaining the flow rate balance between the cylinders and between the intake and exhaust ports without increasing the number of cores of the water jackets.

Solution to Problem

A first aspect of the disclosure is to provide a cylinder head cooling structure in which a plurality of cylinders are disposed in series in a longitudinal direction of an engine, a pair of exhaust ports and a pair of intake ports are disposed opposite to each other in the cylinder, and an injector is installed between the intake ports opposite to the exhaust ports, the cooling structure including: an intake-side cooling passage that extends along an intake side of the cylinder head in the longitudinal direction of the engine; a plurality of inter-cylinder cooling passages that extend between the cylinders in a transverse direction of the engine and include a downstream end which joins the intake-side cooling passage; a plurality of inter-port cooling passages that include an upstream end branching from one inter-cylinder cooling passage, extend between the exhaust port and the intake port in the longitudinal direction of the engine, and include a downstream end which joins another inter-cylinder cooling passage; a plurality of first cooling water supply passages that include an upstream end connected to a cooling water supply passage provided in a cylinder block of the engine and a downstream end which joins an upstream end of the inter-cylinder cooling passage; and a blocking walls that is provided in the inter-cylinder cooling passages and extend obliquely in a direction from the exhaust ports of the cylinder on an upstream side to the intake ports of the cylinder on a downstream side to divide the inter-cylinder cooling passage.

The cooling structure may further include a plurality of second cooling water supply passages that extend between the pair of exhaust ports in the transverse direction of the engine and include an upstream end connected to a cooling water supply passage of the cylinder block and a downstream end which joins the inter-port cooling passage located near the injector.

The cooling structure may further include an exhaust-side cooling passage that extends above the exhaust port on an exhaust side of the cylinder head in the longitudinal direction of the engine; and a third cooling water supply passage that branches from a joining portion between the inter-port cooling passage and the second cooling water supply passage and joins the exhaust cooling passage.

The upstream end of the first cooling water supply passage may be connected to a block-side cooling water circulation passage that is provided in the cylinder block to cool down the cylinder, and the upstream end of the second cooling water supply passage may be connected to a block-side cooling water supply passage that is provided in the cylinder block and directly supplies cooling water cooled by a radiator without passing through the cooling water circulation passage.

A second aspect of the disclosure is to provide a cylinder head cooling structure in which a plurality of cylinders are disposed in series in a longitudinal direction of an engine, a pair of exhaust ports and a pair of intake ports are disposed opposite to each other in the cylinder, and an injector is installed between the intake ports opposite to the exhaust ports, the cooling structure including: an intake-side cooling passage that extends along an intake side of the cylinder head in the longitudinal direction of the engine; a plurality of inter-cylinder cooling passages that extend between the cylinders in a transverse direction of the engine and include an upstream inter-cylinder cooling water passage and a downstream inter-cylinder cooling water passage in which a downstream end thereof joins the intake-side cooling passage; a plurality of inter-port cooling passages that include an upstream end connected to the upstream inter-cylinder cooling passage of one inter-cylinder cooling passage, extend between the exhaust port and the intake port in the longitudinal direction of the engine, and include a downstream end connected to the downstream inter-cylinder cooling passage of the other inter-cylinder cooling passage; a plurality of first cooling water supply passages that include an upstream end connected to a cooling water supply passage provided in a cylinder block of the engine and a downstream end connected to the upstream end of the upstream inter-cylinder cooling passage; and a blocking wall that extends obliquely in a direction from the exhaust ports of the cylinder on an upstream side to the intake ports of the cylinder on a downstream side to divide the inter-cylinder cooling passage into the upstream inter-cylinder cooling passage and the downstream inter-cylinder cooling passage.

Advantageous Effects of the Invention

According to the cooling structure of the present disclosure, it is possible to prevent an increase in pressure loss while effectively maintaining the flow rate balance between the cylinders and between the intake and exhaust ports without increasing the number of cores of the water jackets.

DESCRIPTION OF EMBODIMENTS

Figure 1:
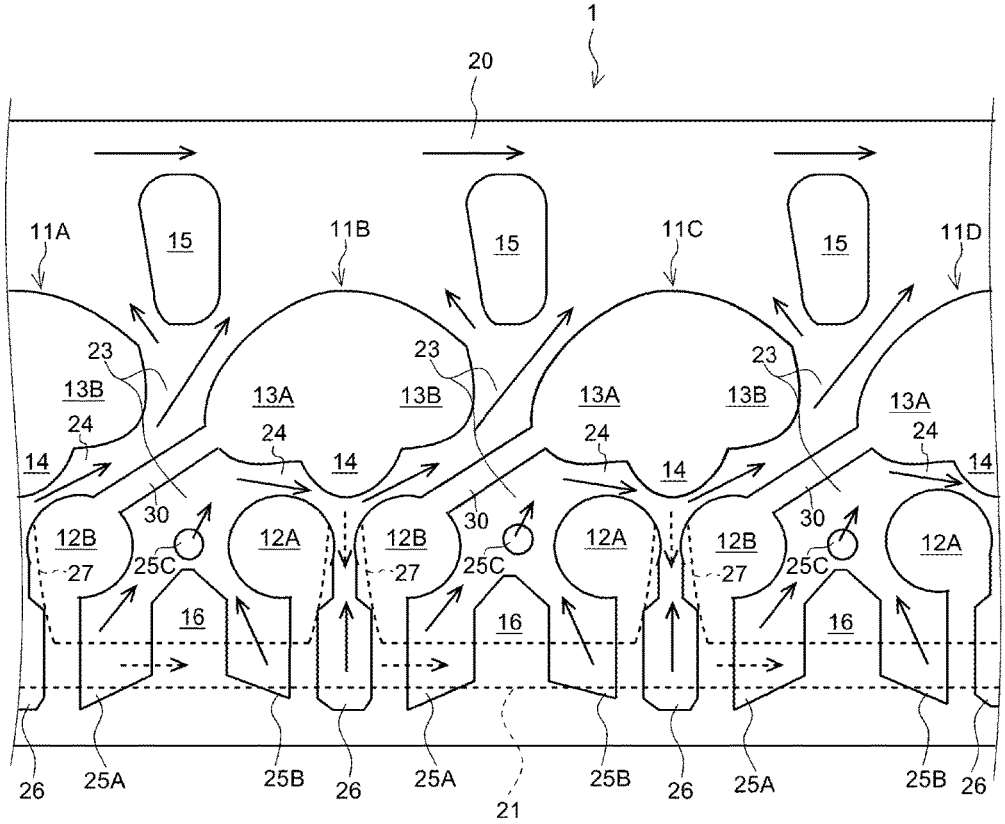
FIG. 1 is a plan view schematically illustrating part of a cylinder head cooling structure according to an embodiment of the invention when viewed from above.

Hereinafter, a cylinder head cooling structure according to an embodiment of the present invention will be described based on the accompanying drawings. The same parts are given the same reference numerals, and their names and functions are also the same. Accordingly, the description on the same part will not be repeated.

FIG. 1 is a plan view schematically illustrating part of a cylinder head cooling structure according to an embodiment of the invention when viewed from above. The cooling structure of the embodiment is applied to a multi-cylinder in-line engine in which a plurality of cylinders are arranged in series in a longitudinal direction (crankshaft direction) of an engine.

As illustrated in FIG. 1, a pair of exhaust ports 12A and 12B respectively accommodating two exhaust valves (not illustrated) and a pair of intake ports 13A and 13B respectively accommodating two intake valves (not illustrated) are disposed to be opposed to each other with a gap in each of cylinders 11A to 11D of a cylinder head 1. An injector installation portion 14 in which an injector is installed (not illustrated) is provided between the intake ports 13A and 13B each facing between the exhaust ports 12A and 12B. In addition, between each of the cylinders 11A to 11D on the intake side and on the exhaust side of the cylinder head 1, boss portions 15 and 16 are provided for inserting a head bolt (not illustrated) thereinto or forming an oil pit and a blow-by passage (both are not illustrated).

On the intake side of the cylinder head 1, an intake-side cooling water passage 20 is provided to extend in the vicinity of each of the cylinders 11A to 11D along a longitudinal direction (vertical direction) of the engine. On the downstream side of the intake-side cooling water passage 20, a cooling water outlet (not illustrated) is provided to return the cooling water to a radiator (not illustrated).

On the exhaust side of the cylinder head 1, an exhaust-side cooling water passage 21 is provided to extend in the upper side of the exhaust ports 12A and 12B along the longitudinal direction of the engine. On the downstream side of the exhaust-side cooling water passage 21, the above-described cooling water outlet (not illustrated) is connected.

Between each of the cylinders 11A to 11D of the cylinder head 1, a plurality of inter-cylinder cooling water passages 23 are provided to extend along a transverse direction (horizontal direction) of the engine and to join the intake-side cooling water passage 20 at the downstream end thereof. A blocking wall 30 (to be described below in detail) is provided in the inter-cylinder cooling water passages 23.

An inter-port cooling water passage 24 is provided between the exhaust ports 12A and 12B and the intake ports 13A and 13B of the cylinder head 1 to extend in the longitudinal direction of the engine. The inter-port cooling water passage 24 is formed such that the inter-port cooling water passage branches from the inter-cylinder cooling water passage (upstream side inter-cylinder passage) 23 positioned on the upstream side in the vertical direction (left side in the drawing) with respect to the cylinder to extend between the exhaust ports 12A and 12B and the intake ports 13A and 13B, and joins the inter-cylinder cooling passage (downstream side inter-cylinder passage) 23 positioned on the downstream side (right side in the drawing) in the vertical direction with respect to the cylinder. Here, the terms of "branch" and "join" are applied to assume a case where the inter-cylinder cooling water passages are directly continuous in the horizontal direction, and in this application, the terms of "branch" and "join" do not limitedly mean the connection relation of three or more passages and also mean the connection relation of two passages.

Figure 2:
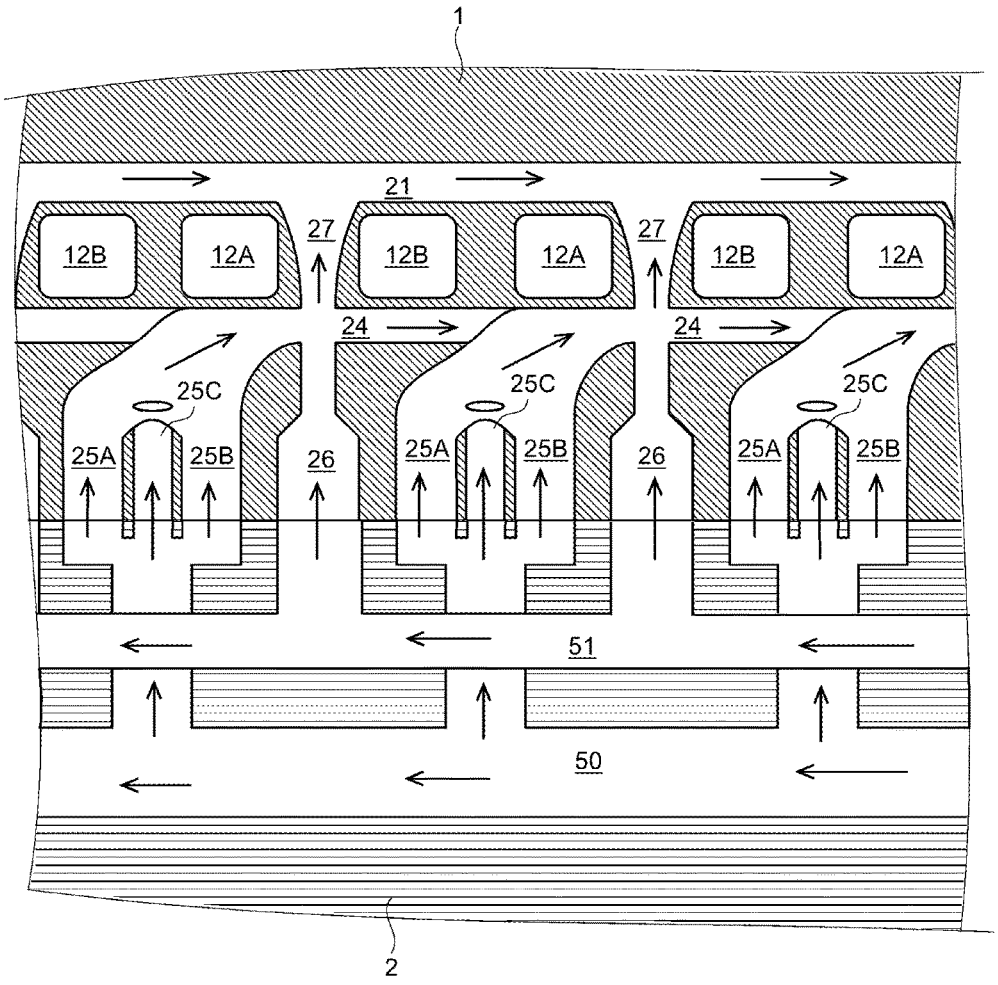
FIG. 2 is a cross-sectional view schematically illustrating part of the cylinder head cooling structure according to the embodiment of the invention when viewed laterally from the exhaust side.

In the cylinder head 1 on the upstream side in the horizontal direction compared to the inter-cylinder cooling water passage 23, three first cooling water supply passages 25A to 25C are provided to extend from the bottom of the cylinder head 1 toward above and to join with each other on the upstream side of the inter-cylinder cooling water passage 23. Upstream ends of these three first cooling water supply passages 25A to 25C are connected to a cylinder block first cooling water supply passage 50 formed in a cylinder block 2 as illustrated in FIG. 2 and cooling a combustion chamber (not illustrated).

A second cooling water supply passage 26 is provided between the exhaust ports 12A and 12B of the cylinder head 1 to extend toward above from the bottom of the cylinder head 1 and to join the inter-port cooling water passage 24 adjacent to the injector installation portion 14 at the downstream end thereof. The upstream end of the second cooling water supply passage 26 is connected to a cylinder block second cooling water supply passage 51, which is formed in the cylinder block 2 illustrated in FIG. 2 and directly introduces the cooling water cooled by the radiator (not illustrated) to the cylinder head 1. That is, the low temperature cooling water introduced from the radiator without cooling the combustion chamber in the cylinder block 2 is directly supplied in the vicinity of the injector installation portion 14 through second cooling water supply passage 26.

In the inter-cylinder cooling water passage 23, the blocking wall 30 is provided to divide and partition the inter-cylinder cooling water passage 23 into two regions. The blocking wall 30 obliquely extends in the inter-cylinder cooling water passage 23 from the exhaust port 12B positioned on the upstream side (left side in the drawing) in the vertical direction with respect to the inter-cylinder cooling water passage 23 toward the intake port 13A positioned on the downstream side (right side in the drawing) in the vertical direction with respect to the inter-cylinder cooling water passage 23. In other words, the cooling water joining the upstream portion of the inter-cylinder cooling water passage 23 from the first cooling water supply passages 25A to 25C is introduced to the inter-port cooling water passage 24 without flowing straight in the horizontal direction, whereby the cooling water flows obliquely in the cylinder head 1.

In the joining portion between the inter-port cooling water passage 24 and the second cooling water supply passage 26 of the cylinder head 1, an exhaust-side supply passage (third cooling water supply passage) 27 is provided which branches from the joining portion to extend toward above and joins the exhaust-side cooling water passage 21 at the downstream end thereof. In other words, a divided structure is achieved with the exhaust-side supply passage 27 such that the exhaust-side cooling water passage 21 and the second cooling water supply passage 26 are connected but, the exhaust-side supply passage 27 and the first cooling water supply passages 25A to 25C are not directly connected, thereby effectively securing a flow rate of the cooling water to be introduced between the high temperature intake and exhaust ports 12 and 13.

As described above, according to the cylinder head cooling structure of the embodiment, by obliquely dividing the inter-cylinder cooling water passage 23 with the blocking wall 30, the cooling water joining at the upstream portion of the inter-cylinder cooling water passage 23 from the first cooling water supply passages 25A to 25C is guided to the inter-port cooling water passage 24 without flowing straight in the horizontal direction to obliquely flow in the cylinder head 1. With this structure, it is possible to effectively maintain the flow rate balance between the cylinders 11A to 11D and between the intake and exhaust ports 12 and 13, thereby preventing an increase in pressure loss. In addition, the cooling water flowing in the inter-port cooling water passage 24 is guided into the intake-side cooling water passage 20 without being used to cool another cylinder, and thus it is possible to effectively prevent an increase in the temperature of the cooling water. Further, it is possible to effectively improve the cooling efficiency of the engine by only providing a water jacket of one stage in the cylinder head 1, thereby effectively preventing an increase in manufacturing cost.

In addition, in the cylinder head cooling structure of the embodiment, the exhaust-side cooling water passage 21 and the second cooling water supply passage 26 are connected through the exhaust-side supply passage 27, but the first cooling water supply passages 25A to 25C and the exhaust-side cooling water passage 21 have a division structure in which these passages are not directly connected. With the structure, it is possible to secure the flow rate of the cooling water to be guided between the high-temperature intake and exhaust ports 12 and 13, thereby effectively improving the cooling efficiency.

Further, according to the cylinder head cooling structure of the embodiment, the downstream end of the second cooling water supply passage 26, which extends between the exhaust ports 12A and B and joins the inter-port cooling water passage 24 adjacent to the injector installation portion 14, is connected to the cylinder block second cooling water supply passage 51 which is provided in the cylinder block 2 and directly introduces the cooling water cooled by the radiator to the cylinder head 1. With this structure, the low temperature cooling water is directly supplied to the high temperature injector installation portion 14 though the second cooling water supply passage 26, thereby reliably improving the cooling performance.

The present invention is not limited to the above-described embodiment and may be appropriately changed and implemented without departing from the spirit of the invention.

This application is based upon and claims the benefit of priority from Japanese Patent Application No. 2015-154783, filed Aug. 5, 2015, the entire contents of which are incorporated herein by reference.

INDUSTRIAL APPLICABILITY

According to the cooling structure of the present disclosure, it is possible to prevent an increase in pressure loss while effectively maintaining the flow rate balance between the cylinders and between the intake and exhaust ports without increasing the number of cores of the water jackets.

REFERENCE SIGNS LIST

1: cylinder head
2: cylinder block
11A, 11B, 11C, 11D: cylinder
12A, 12B: exhaust port
13A, 13B: intake port
14: injector installation portion
15, 16: boss portion
20: intake-side cooling water passage
21: exhaust-side cooling water passage
23: inter-cylinder cooling water passage
24: inter-port cooling water passage
25A, 25B, 25C: first cooling water supply passage
26: second cooling water supply passage
27: exhaust-side supply passage
30: blocking wall
50: cylinder block first cooling water supply passage
51: cylinder block second cooling water supply passage

The invention claimed is:

1. A cylinder head cooling structure in which a plurality of cylinders are disposed in series in a longitudinal direction of an engine, a pair of exhaust ports and a pair of intake ports are disposed opposite to each other in the cylinder, and an injector is installed between the intake ports opposite to the exhaust ports, the cooling structure comprising:

an intake-side cooling passage that extends along an intake side of the cylinder head in the longitudinal direction of the engine;

a plurality of inter-cylinder cooling passages that extend between the cylinders in a transverse direction of the engine and include a downstream end which joins the intake-side cooling passage;

a plurality of inter-port cooling passages that include an upstream end branching from one inter-cylinder cooling passage, extend between the exhaust port and the intake port in the longitudinal direction of the engine, and include a downstream end which joins another inter-cylinder cooling passage;

a plurality of first cooling water supply passages that include an upstream end connected to a cooling water supply passage provided in a cylinder block of the engine and a downstream end which joins the upstream end of the inter-cylinder cooling passage; and a blocking wall that is provided in the inter-cylinder cooling passages to connect the exhaust port of the cylinder with the intake port of the adjacent cylinder and extend obliquely in a direction from the exhaust ports of the cylinder on an upstream side to the intake ports of the cylinder on a downstream side to divide the inter-cylinder cooling passage.

2. The cooling structure according to claim 1, further comprising:

a plurality of second cooling water supply passages that extend between the pair of exhaust ports in the transverse direction of the engine and include an upstream end connected to a cooling water supply passage of the cylinder block and a downstream end which joins the inter-port cooling passage located near the injector.

3. The cooling structure according to claim 2, further comprising:

an exhaust-side cooling passage that extends above the exhaust port on an exhaust side of the cylinder head in the longitudinal direction of the engine; and a third cooling water supply passage that branches from a joining portion between the inter-port cooling passage and the second cooling water supply passage and joins the exhaust cooling passage.

4. The cooling structure according to claim 2, wherein the upstream end of the first cooling water supply passage is connected to a block-side cooling water circulation passage that is provided in the cylinder block to cool down the cylinder, and the upstream end of the second cooling water supply passage is connected to a block-side cooling water supply passage that is provided in the cylinder block and directly supplies cooling water cooled by a radiator without passing through the cooling water circulation passage.

5. A cylinder head cooling structure in which a plurality of cylinders are disposed in series in a longitudinal direction of an engine, a pair of exhaust ports and a pair of intake ports are disposed opposite to each other in the cylinder, and an injector is installed between the intake ports opposite to the exhaust ports, the cooling structure comprising:

an intake-side cooling passage that extends along an intake side of the cylinder head in the longitudinal direction of the engine;

a plurality of inter-cylinder cooling passages that extend between the cylinders in a transverse direction of the engine and include an upstream inter-cylinder cooling water passage and a downstream inter-cylinder cooling water passage in which a downstream end thereof joins the intake-side cooling passage;

a plurality of inter-port cooling passages that include an upstream end connected to the upstream inter-cylinder cooling passage of one inter-cylinder cooling passage, extend between the exhaust port and the intake port in the longitudinal direction of the engine, and include a downstream end connected to the downstream inter-cylinder cooling passage of the other inter-cylinder cooling passage;

a plurality of first cooling water supply passages that include an upstream end connected to a cooling water supply passage provided in a cylinder block of the engine and a downstream end connected to the upstream end of the upstream inter-cylinder cooling passage; and a blocking wall that is provided to connect the exhaust port of the cylinder with the intake port of the adjacent cylinder and extends obliquely in a direction from the exhaust ports of the cylinder on an upstream side to the intake ports of the cylinder on a downstream side to divide the inter-cylinder cooling passage into the upstream inter-cylinder cooling passage and the downstream inter-cylinder cooling passage.

* * * * *